US005964654A

United States Patent [19]

Ewert et al.

[11] Patent Number: 5,964,654

[45] Date of Patent: Oct. 12, 1999

[54] MULTIPLE ABRASIVE BELT MACHINE

[75] Inventors: Terry S. Ewert; Gregory L Staab, both of Abbotsford, Wis.

[73] Assignee: Westar Mfg. Corp., Dorchester, Wis.

[21] Appl. No.: 08/935,437

[22] Filed: Sep. 23, 1997

[51] Int. Cl.[6] ..... B24B 21/00

[52] U.S. Cl. ..... 451/296; 451/303; 451/65; 451/57; 474/84

[58] Field of Search ..... 451/296, 303, 451/65, 57; 474/84

[56] References Cited

U.S. PATENT DOCUMENTS

| | | | |
|---|---|---|---|
| 933,035 | 9/1909 | Jackoboice et al. . | |
| 1,096,882 | 5/1914 | Wysong . | |
| 1,519,425 | 12/1924 | Walker et al. . | |
| 2,061,607 | 11/1936 | Andrie . | |
| 2,452,205 | 10/1948 | Newton . | |
| 2,589,017 | 3/1952 | Moore . | |
| 2,624,158 | 1/1953 | Hendrickson . | |
| 4,091,574 | 5/1978 | Horwitz | 451/303 |
| 4,231,193 | 11/1980 | Siegel | 451/303 |
| 4,535,568 | 8/1985 | LaFave . | |
| 4,664,645 | 5/1987 | Muck et al. | 474/84 |
| 4,922,727 | 5/1990 | Viegas | 474/84 |
| 5,359,813 | 11/1994 | Kaiser, Jr. et al. . | |
| 5,388,373 | 2/1995 | Abbate et al. . | |

*Primary Examiner*—David A. Scherbel
*Assistant Examiner*—Shantese McDonald
*Attorney, Agent, or Firm*—Kinney & Lange, P.A.

[57] ABSTRACT

The present invention includes a multiple abrasive belt apparatus in which endless abrasive belts are movable in a circuitous manner. Discrete belt assemblies each including an abrasive belt are mounted on a support structure and a single motor is used to run all of the discrete belt assemblies. A jack shaft is operatively connected to the motor by a first drive belt, and then in turn is operatively connected to first and second drive shafts by second and third drive belts. The first and second drive shafts are operatively connected, each to two discrete belt assemblies such that motive force is transferred from a single motor to four discrete belt assemblies.

13 Claims, 5 Drawing Sheets

MULTIPLE ABRASIVE BELT MACHINE

BACKGROUND OF THE INVENTION

The present invention relates to abrasive belt machines that use endless abrasive belts, and in particular, it relates to machines that use multiple abrasive belts.

The following U.S. Patents describe abrasive belt machines of various types:

| | U.S. Pat. No. |
|---|---|
| Gleason | 933,305 |
| Wysong | 1,096,882 |
| Walker et al. | 1,519,425 |
| Andrie | 2,061,607 |
| Newton | 2,452,205 |
| Moore | 2,589,017 |
| Hendrickson | 2,624,158 |
| Lefave | 4,535,568 |
| Kaiser, Jr. et al. | 5,359,813 |
| Abbate et al. | 5,388,373 |

The Walker U.S. Pat. No. 1,519,425 discloses the use of three abrasive belts, with all three belts being driven by the same motor at the same speed. The Kaiser, Jr. et al. U.S. Pat. No. 5,359,813 describes a cam shaft grinding machine having six belts that are all driven by a single motor and are driven at the same speed. The Abbate et al. U.S. Pat. No. 5,388,373 describes a needle grinding machine having three belts.

BRIEF SUMMARY OF THE INVENTION

The present invention includes a multiple abrasive belt machine having a plurality of discrete belt assemblies that drive endless abrasive belts. The machine includes a support structure on which a single motor is mounted. A jack shaft is rotatably mounted on the support structure and is operatively connected to the single motor by a first drive belt. First and second drive shafts are also rotatably secured to the support structure and each drive shaft is operatively connected at each end to a discrete abrasive belt assembly. Second and third drive belts operatively connect the first and second drive shafts, respectively, to the jack shaft. Motive force from the motor is transferred through the drive belts to the jack shaft and from the jack shaft to the first and second drive shafts such that each of the belt assemblies is operated from a single motor. Preferably, the size of the pulleys that connect the drive belts between the jack shaft and the first and second drive shafts are selected so that the first and second drive shafts can be operated at different speeds while still using a single motor.

The abrasive belt assemblies include three work areas on each of the abrasive belts, a firm platen area, a soft abrasive work area, and an arcuate abrasive work area.

DETAILED DESCRIPTION OF THE PREFERRED EMBODIMENTS

Figure 1:
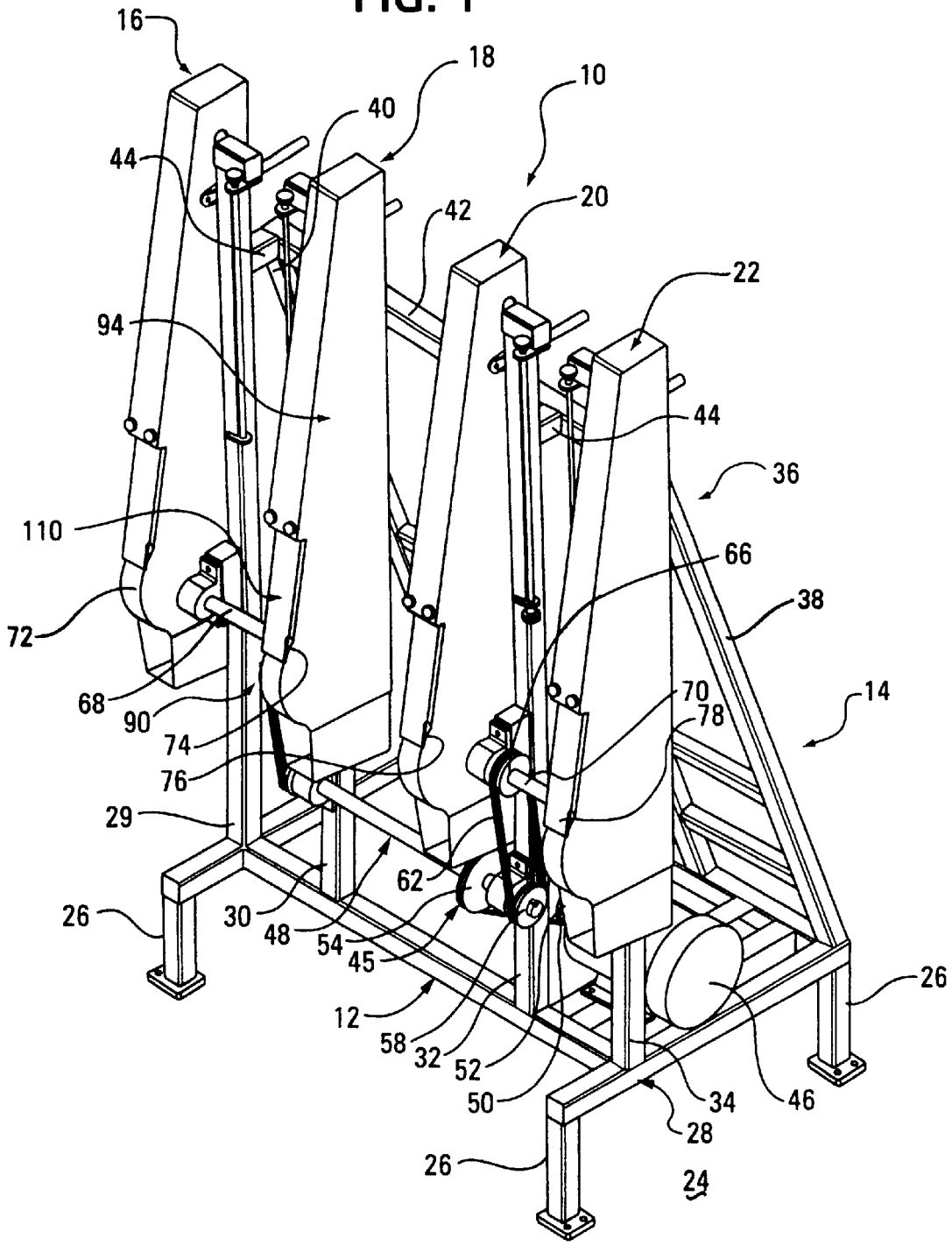
FIG. 1 is a perspective view of the multiple abrasive belt machine of the present invention with guards removed from the drive mechanism and without dust collection trays.

A multiple abrasive belt machine of the present invention is generally indicated at 10 in FIG. 1. The machine 10 includes a floor engaging support 12 positioned on a floor 24 and an upper support structure 14 on which four abrasive belt assemblies 16, 18, 20 and 22 are mounted thereon. The abrasive belt assemblies 16, 18, 20 and 22 are disposed in a substantially vertical orientation with respect to the floor 24 thereby minimizing the amount of space that the machine 10 of the present invention occupies. In one working embodiment, the machine of the present invention occupies a floor space of approximately 3½ feet by approximately 5 feet with a height of approximately 8½ feet high. The abrasive belts used in this machine were approximately 3 inches in width and approximately 132 inches in length.

The floor engaging support 12 includes floor engaging legs 26 (one of which is not illustrated) and a horizontal support section 28 supported by the four floor legs 26. The horizontal support 28 may take many forms. The primary criteria is that it provide sufficient support to the four abrasive belt assemblies 16, 18, 20 and 22. In the form illustrated in FIG. 2, the support 28 comprises a plurality of bar members welded together.

Each of the abrasive belt assemblies 16, 18, 20 and 22 are mounted on vertical support posts 29, 30, 32 and 34, all respectively. The vertical support posts 29, 30, 32 and 34 are also supported by a back section 36 of the upper support assembly 14 providing a brace-type support to each of the posts 29, 30, 32 and 34. The upper support section 14 includes two vertical members 38 and 40 that are inclined towards the posts 29, 30, 32 and 34 and a header member 42 preferably welded to the top of members 38 and 40 and connected to each of the posts, 29, 30, 32 and 34 through identical short horizontal support members 44 (two of which are not illustrated).

Drive Mechanism

The four belt assemblies 16, 18, 20 and 22 are uniquely driven by a drive mechanism 45 having a single electric motor 46 mounted on the support 12. Motive force from the motor 46 is transmitted to a jack shaft 48 that is rotatably mounted by suitable bearings to support posts 30 and 32 thereby extending between the support posts 30 and 32. Motive force is transferred through a lower endless drive belt 50 that engages a pulley 52 on the motor 46 and a pulley 54 on the jack shaft 48. Motive force is then transferred from the jack shaft 48 through jack shaft pulleys 56 and 58 which are attached to the jack shaft at opposite ends of the shaft 48. Left and right jack shaft belts 60 and 62 respectively engage the jack shaft pulleys 56 and 58 and contact wheel shaft pulleys 64 and 66. The pulleys 64 and 65 are attached to contact wheel shafts 68 and 70, respectively. The contact wheel shaft 68 is mounted on suitable bearings to the support posts 29 and 30 and extends between the posts 29 and 30. Likewise, contact wheel shaft 70 is rotatably mounted on posts 32 and 34 by suitable bearings and extends between the posts 32 and 34.

The shaft 68 in turn is operatively connected to provide motive force to contact wheel 72 at one end of the shaft 68 and to contact wheel 74 at an opposite end of the shaft 68.

The wheel 72 provides motive force to the abrasive belt assembly 16 while the wheel 74 then provides motive force to the abrasive belt assembly 18.

Similarly, the shaft 70 in turn is operatively connected to provide motive force to the contact wheel 76 at one end of the shaft and to the contact wheel 78 at an opposite end of the shaft 70. The wheel 76 provides motive force to the abrasive belt assembly 20 while the wheel 78 provides motive force to the abrasive belt assembly 22. Each contact wheel may have a different durometer rubber facing which is suitable for a particular operation.

The driving mechanism 45 of the present invention provides an economical method of transmitting motive force from one motor to four discrete abrasive belt assemblies. In addition, by selectively sizing pulleys 56 and 58, shafts 68 and 70 may be operated at different speeds although using one motor. In turn, this results in abrasive belt assemblies 16 and 18 being operable at a different speed than abrasive belt assemblies 20 and 22. The ability to operate two of the abrasive belt assemblies at a different speed than the other two abrasive belt assemblies, provides the operator with flexibility to equip abrasive belts of different grit sizes so that each abrasive belt assembly may provide a different operation. For example, one abrasive belt assembly may have a coarse grit abrasive belt, and a medium grit abrasive belt, while the other two abrasive belt assemblies may have a fine grit and a buff or polishing belt. Such versatility provides a machine shop with several grit size ready-to-use belts without the need to take a belt off and replace it with a different grit size belt or to operate discrete sanding belt machines each driven by a separate motor if different speeds are needed for selected operations. With abrasive belts of four different grit sizes, a workpiece may be completely finished, that is, sanded through several grit sizes and then buffed or polished in an efficient manner.

Abrasive Belt Assemblies

Since each of the abrasive belt assemblies 16, 18, 20 and 22 contain-like elements, only one abrasive belt assembly 18 will be described.

Figure 3A:
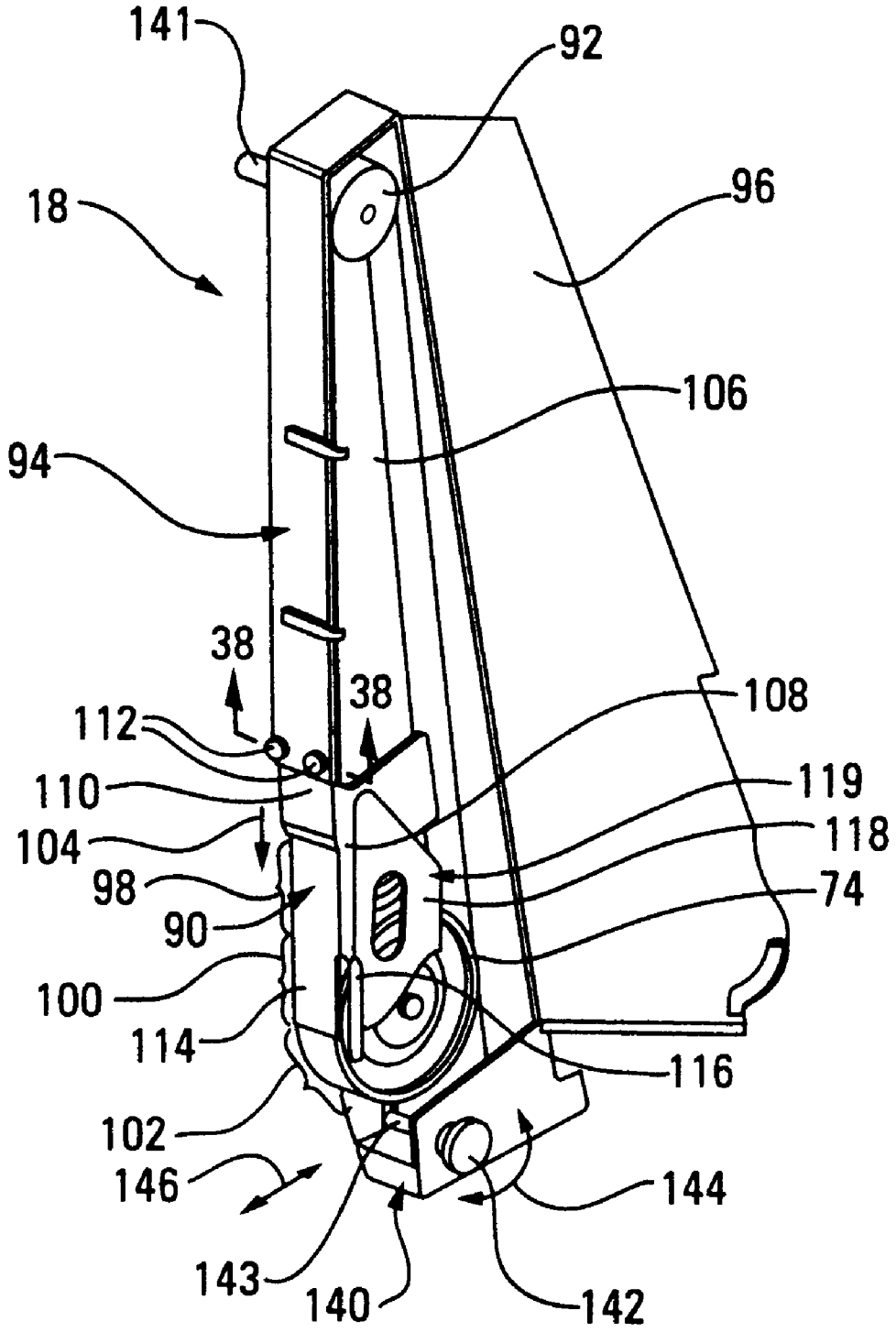
FIG. 3A is a perspective view of an abrasive belt assembly of the present invention.
Figure 4B:
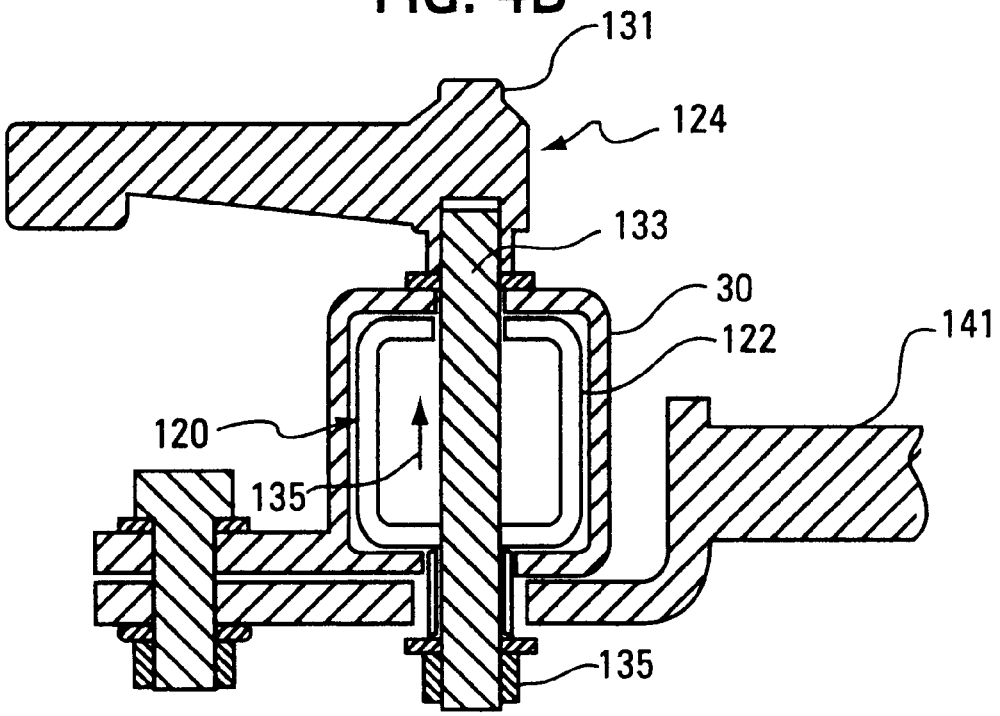
FIG. 4B is a cross-sectional view taken along the line 4B—4B in FIG. 4A of the tension locking mechanism.
Figure 4A:
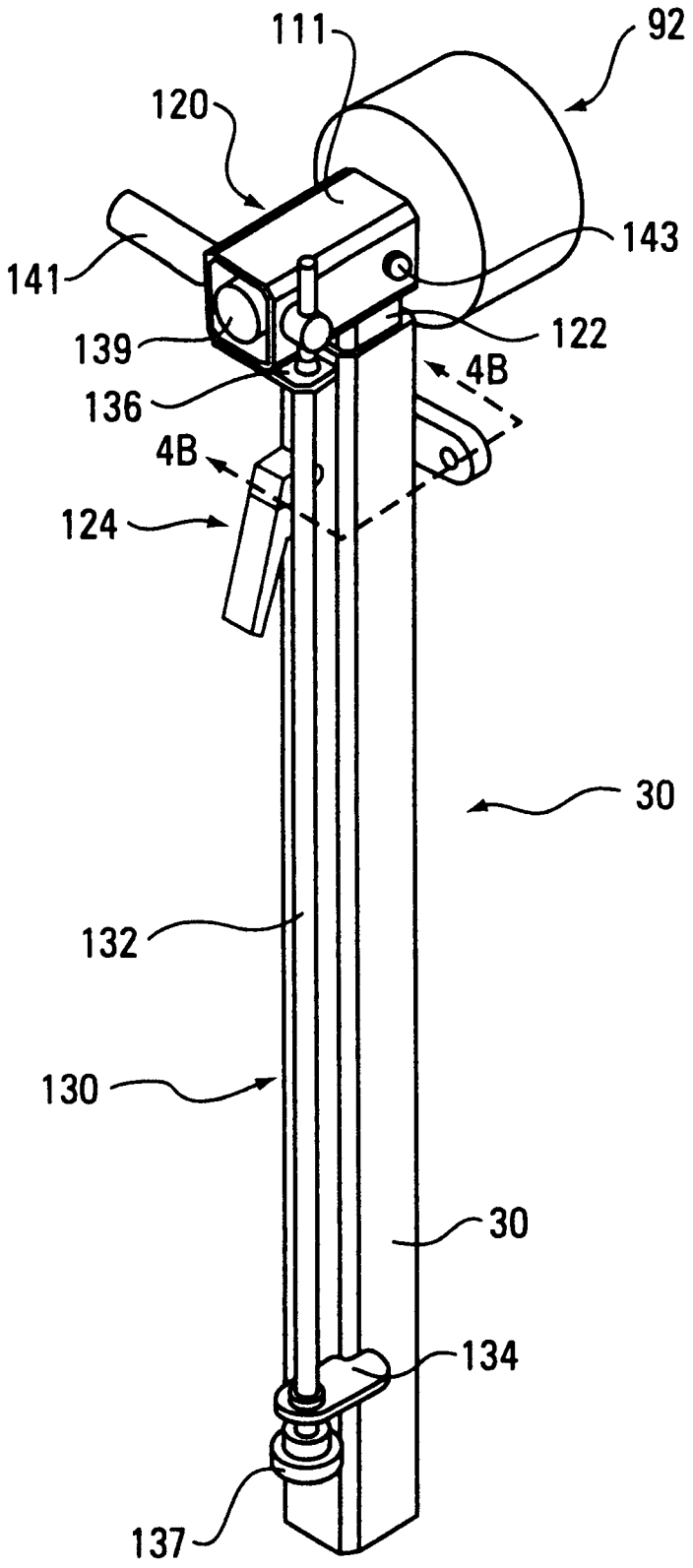
FIG. 4A is a perspective view of tensioning and tracking mechanisms of the present invention.

The abrasive belt assembly 18 as best illustrated in FIGS. 3A and 4A includes a continuous abrasive belt 90 of a selected grit size that extends around the contact wheel 74 at a lower end and around an idler pulley 92 at an upper end. The belt 90 moves in a circuitous manner around pulley 92 and wheel 74. The arrangement of the wheel 74 and the pulley 92, that is the pulley 92 being positioned above the wheel 74 in a vertical relationship, positions the belt 90 in a vertical space saving manner. The contact wheel 74 drives the belt while the idler pulley 92 is used to set the tension on the belt and aid in tracking the belt properly.

The abrasive belt assembly includes a sheet metal guard-type covering 94 that encompasses the wheel 74, the pulley 92 and the majority of the abrasive belt 90 primarily for safety reasons. The guard-type covering 94 includes at least one panel section 96 that pivots along a hinge (not illustrated) to reveal the moving parts of the abrasive belt assembly for maintenance and for changing the belt 90.

The abrasive belt assembly includes three working areas, a platen area 98, a soft pocket area 100 and a contact wheel area 102. The belt 90 moves at its front side in a generally downward direction as indicated by arrow 104 and in a generally upward direction at its back side as indicated by arrow 106.

Figure 3B:
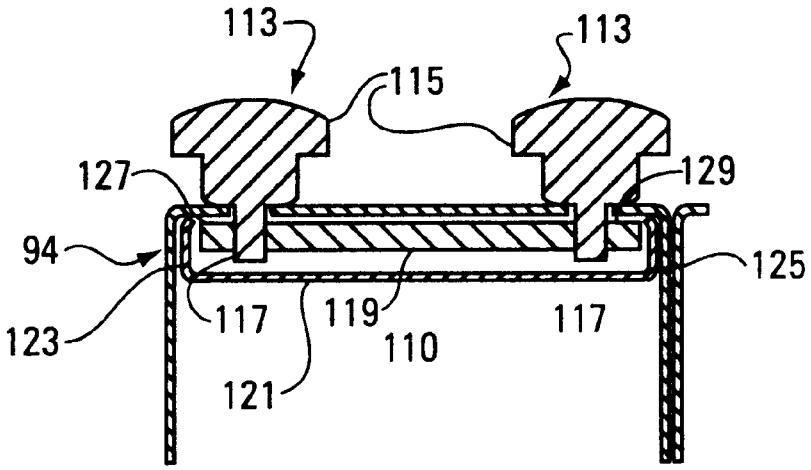
FIG. 3B is a cross-sectional view taken along the line 3B—3B in FIG. 3A.

The platen area 98 is a flat area supported by a stationary flat metal surface 108 that provides an area that is both flat and firmly supported. The platen area 98 also includes a guard 110 that preferably comprises a flat piece of sheet metal that is slidable upwardly within the guard-type protector 94 exposing the platen area for use. The guard 110 is frictionally secured in an upward position by a set of thumb wheel-type screws 113 as best illustrated in FIG. 3B. The guard 110 is slidably positioned over the platen area when the platen area is not in use. The platen area is useful for sanding flat sided workpieces.

The thumb wheel-type screws 113 each have handle sections 115 and threaded shank sections 117 that extends through suitable apertures in the sheet metal guard-type covering 94. The threaded shank sections 117 threadably engage threaded apertures in a friction plate 119 located on a side of the sheet metal guardtype covering 94 opposite from the handle sections 115 of the thumb wheel-type screws 113. The guard 110, as viewed cross-sectionally in FIG. 3B includes a primary guard area 121 and left and right C-shaped end sections 123 and 125, respectively, each with respective end portions 127 and 129 respectively that extend towards each other. The end portions 127 and 129 of the guard 110 are disposed between the plate 119 and the guard-type protector 94. To secure the guard 110 in either an upward position or positioned over the platen area when the platen area is not in use, handles sections 115 are turned to threadably move the shank sections 117 of the thumb wheel-type screws to frictionally engage the end portions 127 and 129 between the plate 119 and guard-type protector 94.

The soft pocket area 100 of the sanding belt starts at a lower end of the platen area support 108 and extends up to a point where the contact wheel 74 engages the back side of the belt 90. The soft pocket area permits the sanding or polishing of a workpiece having a non-flat surface such as round stock or stock having an arcuate surface. When the workpiece is placed against the abrasive belt in the soft pocket area, the belt will move inwardly into the assembly, with its abrasive surface conforming to the surface of the workpiece.

To protect the operator's fingers and hands, a pivotal guard assembly 112 is provided. The pivotal guard assembly 112 prevents hands or fingers from being placed along the edge of the belt 90 or behind the belt 90 and lessens the chance of abrading or cutting the hands or fingers of the operator.

The pivotal guard assembly includes left and right guard bumpers 114 and 116 that are each fixedly attached to a pivoting guard member 118 and which are positioned adjacent opposite edges of the belt 90. As illustrated in FIG. 3A, bumper 116 is attached to the pivoting guard member 118. Similarly, bumper 114 is attached to a guard member (not illustrated) identical to member 118. Both guard members are pivotally secured to the assembly at an upper end by a suitable pin.

As a workpiece is positioned in the soft pocket area, any portion of the workpiece that extends beyond the sanding belt moves the guard member by engagement of the respective bumper rearwardly. The bumper since it is adjacent the edges of the abrasive belt prevents touching of the edges of the belt with a hand or finger of the operator or placement of any portion of the workpiece along the edge or behind the abrasive belt.

The contact wheel area provides an abrasive belt surface in a generally arcuate configuration. The abrasive belt in the contact wheel area is supported by the contact wheel The contact wheel has an outer surface of a rubber-type material so that it frictionally engages the back of the abrasive belt to transfer motive force to the belt and to provide a support surface for sanding in that area.

To adjust the tension of the abrasive belt, the abrasive belt assembly is provided with the idler pulley 92 mounted on a movable head tube 120, as illustrated in FIG. 4A. The head tube 120 has a downwardly extending section 122 that extends inside of post 30 at an upper end thereof and is secured to a horizontally disposed upper tube section 111. A spring (not illustrated) provides a force upwardly biasing the head tube 120 in an upward direction. This biasing force by the spring is counteracted by the sanding belt being disposed around the idler pulley 92 and around the contact wheel.

A lock handle assembly 124 secures the head tube 120 in a selected vertical position with respect to the post 30. As best illustrated in FIG. 4B, the lock handle assembly 124 includes a handle section 131 fixedly attached to a shank section 133 that extends through a slotted aperture in the vertical post 30 and a slotted aperture in the section 122 of the head tube 120 and at a distal end threadably engages a nut section 135. The nut section 135 when the shank section 133 is turned by the handle 131 against the section 122 in the direction indicated by arrow 135 placing the section 122 in frictional engagement with the inside wall of the vertical post 30.

The proper tension to the abrasive belt is provided by turning the handle assembly 124 thereby unlocking the head tube 120 with respect to the post 30 and permitting the spring (not illustrated) to bias the head tube 120 upwardly. The spring is selected to provide the proper tension or running the belt 90. Once the proper tension has been provided by the spring, the position of the head tube 120 is locked with respect to the post 30 through lock handle assembly 124. Tension relief handle 141 may be grasped to pull the head tube 120 and the idler pulley 92 downwardly against the spring (not illustrated) tension when the lock handle assembly 124 is in an unlocked state.

The tracking of the abrasive belt is adjusted by tracking assembly 130. The tracking assembly 130 includes a tracking shaft 132 secured at a lower end to the post 30 by a lower mounting tab 134 and to the head tube 120 by an upper mounting tab 136. The upper tab 136 is disposed on the head tube 120 on a side opposite from the idler pulley 192. The shaft 130 at its lower end below the lower tab 134 is fixedly attached to shaft turning handle 137. The shaft 130 is rotatable within the lower and upper mounting tabs 134 and 136.

The pulley 92 is rotatably attached to pulley shaft 139. The pulley shaft 139 is secured to the head tube 120 and pivots within the head tube 120 by pivot pin 143. An upper end of the tracking shaft 132 is in threadable engagement with upper tube pivot shaft 141 that extends through suitable slots within the head tube 120 and is secured to the pulley shaft 139 by passing therethrough.

In use, the sanding belt which at its upper end extends around the idler pulley provides tension to the idler pulley. To adjust tracking of the sanding belt, the knob 137 is turned either clockwise or counterclockwise. This turning of the knob will then turn the upper end of the tracking shaft 132 and due to threadable engagement with the shaft 141, will move the shaft 141 in either an upward or downward direction thereby pivoting the pulley shaft 139 about pivot pin 143 and moving the idler pulley either upwardly or downwardly.

Referring back to FIG. 3, the sanding belt assembly is preferably equipped with a dust collection tray 140 that is positioned within a lower end of the guard-type covering 94 directly below the contact wheel 74. The tray 140 is secured by friction by tightening or loosening of collection tray knob 142 as indicated by arrow 144. The collection tray knob 142 threadably engages bolt 143 such that turning the knob 142 acts against the sides of the guard-type covering 94 adjacent to the tray to frictionally hold the tray in a selected position. The tray can be slid in or out as indicated by arrow 146 and then held in position by the tray knob 142 and bolt 143.

Figure 5:
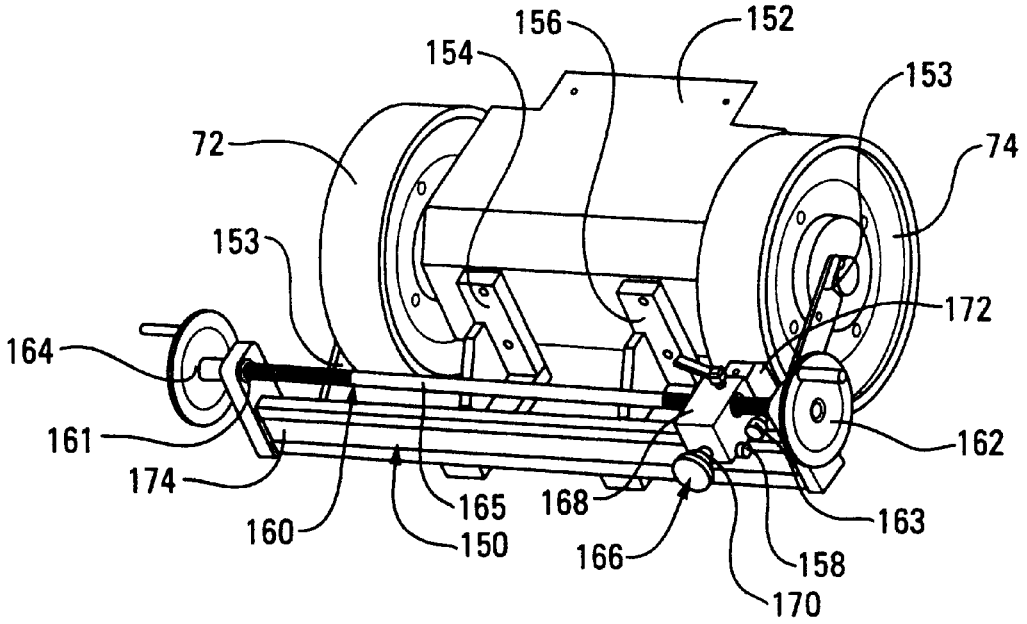
FIG. 5 is a perspective view of a dressing operation of contact wheels of the present invention.

Prior to operation or when worn unevenly, the contact wheels 72, 74, 76 and 78 should be dressed to provide proper tracking of the abrasive belt in each abrasive belt assembly. Each pair of contact wheels, that is wheels 72 and 74, and wheels 76 and 78 will be dressed in a like fashion, and therefore, only the dressing of one pair of wheels, wheels 72 and 74 will be described with reference to FIG. 5.

Figure 2:
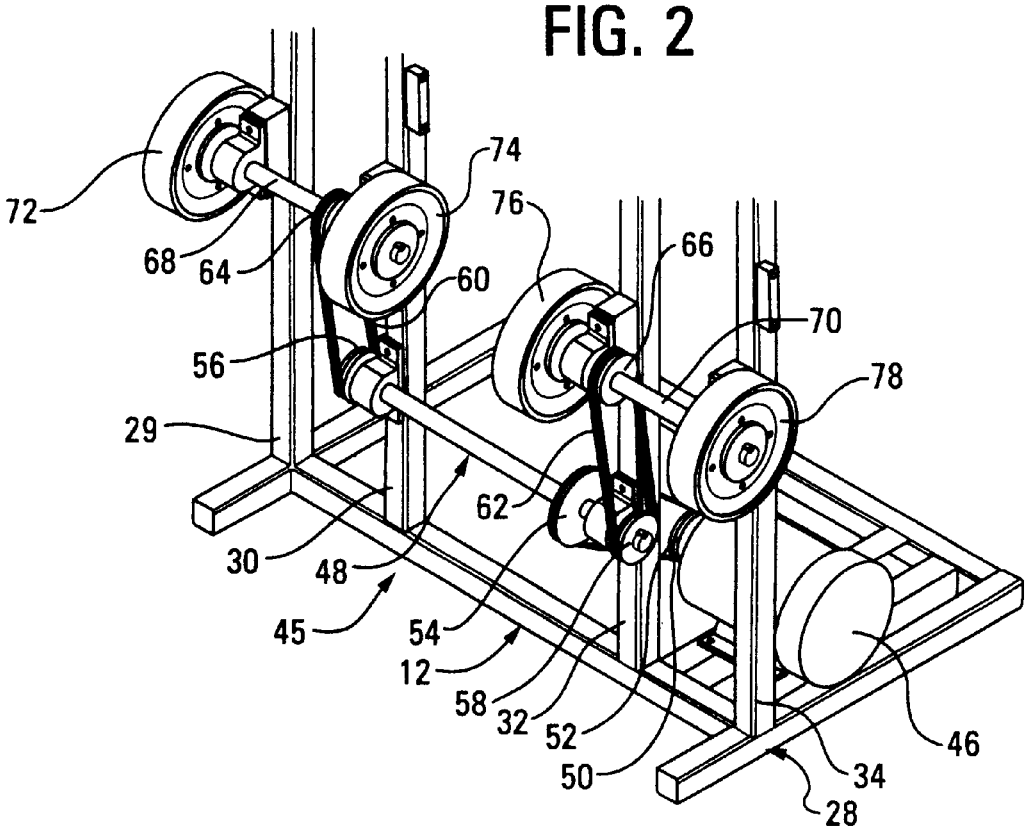
FIG. 2 a perspective view of the drive mechanism with the safety guards removed for purposes of clarity.

A wheel dresser assembly 150 is mounted to a guard plate 152 that covers the shaft 68 as illustrated in FIG. 2. Spacers 153 are used to square the dresser assembly 150 with respect to the wheels 72 and 74. The wheel dresser assembly 150 is mounted through mounting brackets 154 and 156 by suitable screws (not illustrated). Once the dresser assembly is squared with respect to the wheels 72 and 74, the screws (not illustrated) are used to secure the mounting brackets 154 and 156 to the guard plate 152.

The dresser assembly includes a dressing tool 158 that travels on a shaft 160. The shaft 160 includes two threaded areas 161 and 163 that face wheels 72 and 74, respectively. The dressing tool threadably engages these sections when used to dress each of the respective wheels. Once the wheel is dressed, the tool may be slid through the mid-portion 165 of shaft 160 to engage the threaded section of the wheel that has not been dressed. An adjustment knob 166 threadably engages a main body 168 of the tool 158 through a threaded shaft 170 that is fixed to a dressing blade 172 at an end closest to either contact wheel. The assembly 150 also includes a support plate 174 that the main body 168 of the tool 158 slidably engages. Hand wheels 162 and 164 move the dressing tool 158 along either of the threaded sections 161 or 163 by turning the shaft 160. The dressing blade 172 is moved to contact the contact wheel to cut into the rubber facing for dressing the wheel.

Although the present invention has been described with reference to preferred embodiments, workers skilled in the art will recognize that changes may be made in form and detail without departing from the spirit and scope of the invention.

We claim:

1. A multiple abrasive belt apparatus, the apparatus comprising:

a support structure;

a first discrete abrasive belt assembly in which a first endless abrasive belt is moved in a circuitous manner, the first belt assembly being mounted on the support structure;

a second discrete abrasive belt assembly in which a second endless abrasive belt is moved in a circuitous manner, the second belt assembly being mounted on the support structure;

a third discrete abrasive belt assembly in which an endless abrasive belt is moved in a circuitous manner, the third belt assembly being mounted on the support structure;

a fourth discrete abrasive belt assembly in which an endless abrasive belt is moved in a circuitous manner, the fourth belt assembly being mounted on the support structure;

a single motor disposed on the support structure;

a jack shaft rotatably secured to the support structure;

a first drive shaft rotatably secured to the support structure and being operatively connected at each end to the first and second discrete abrasive belt assemblies;

a second drive shaft being rotatably secured to the support structure and being operatively connected at each end to the third and fourth discrete abrasive belt assemblies;

a first drive belt rotatably connecting the motor to the jack shaft such that motive force is transferred from the motor to the jack shaft;

a second drive belt rotatably connecting the jack shaft to the first drive shaft such that motive force is transferred from the jack shaft to the first drive shaft;

a third drive belt rotatably connecting the jack shaft to the second drive shaft such that motive force is transferred from the jack shaft to the second drive shaft; and wherein motive force is transferred from the single motor to the first, second, third and fourth discrete belt assemblies.

2. The apparatus of claim 1 and further including:

first and second pulleys attached to the jack shaft and operatively engaging the first and second drive belts, respectively, and wherein the first pulley is of a different diameter than the second pulley such that the second and third drive shafts turn at different speeds.

3. The apparatus of claim 1 and further including first and second pulleys operatively attached to the first and second drive shafts, the first and second pulleys being of different diameters such that the first and second drive shafts are rotatable at different speeds.

4. The apparatus of claim 1 wherein the first, second, third and fourth abrasive belt assemblies each include a first wheel, and a second wheel, the second wheel disposed vertically above the first wheel, and the abrasive belt being movable around each of the wheels.

5. The apparatus of claim 1 wherein the first discrete abrasive belt assembly includes:

a platen abrasive belt work area being substantially flat and being supported by a fixed plate surface secured to the supports structure;

a soft abrasive belt work area being unsupported; and an arcuate belt work area being supported by an arcuate wheel.

6. The apparatus of claim 1 wherein the first, second, third and fourth discrete abrasive belt assemblies each include:

a platen abrasive belt work area being substantially flat and being supported by a fixed plate surface secured to the support structure;

a soft abrasive belt work area being unsupported; and an acuate belt work area being supported by arcuate wheel.

7. The apparatus of claim 1 wherein the first, second, third and fourth discrete abrasive belt assemblies each include an abrasive belt of a different grit size.

8. A multiple abrasive belt apparatus, the apparatus comprising:

a support structure;

first, second, third and fourth abrasive belt means, each including an endless abrasive belt that is moved in a circuitous manner;

a single motor mounted on the support structure;

first shaft means rotatably mounted on the support structure;

second and third shaft means mounted on the support structure and being spaced a selected distance from the first shaft means, the second shaft means being operatively connected to the first and second abrasive belt means and the third shaft means being operatively connected to the third and fourth abrasive belt means; and belt drive means for transferring motive force from the motor to the first shaft means, and then for transferring motive force from the first shaft means to the second and third shaft means such that motive force is transferred from the single motor to the first, second, third and fourth abrasive belt means.

9. The apparatus of claim 8 and further including means for transferring motive force from the first shaft to the second shaft at a different speed than motive force is transferred from the first shaft to the third shaft.

10. The apparatus of claim 8 wherein the first, second, third and fourth abrasive belt assemblies each have a lower wheel and an upper wheel spaced from each other in a vertical relationship and wherein the abrasive belt is movable around the lower and upper wheels.

11. The apparatus of claim 8 wherein the first belt means includes:

a platen abrasive belt work area being substantially flat and being supported by a fixed plate surface secured to the support structure;

a soft abrasive belt work area being unsupported; and an acuate belt work area being supported by a wheel.

12. The apparatus of claim 8 wherein the first, second, third and fourth abrasive belt means each include an endless abrasive belt having a different grit size.

13. The apparatus of claim 8 wherein the first, second, third and fourth abrasive belt means, each include:

a platen abrasive belt work area being substantially flat and being supported by a fixed plate surface secured to the support structure;

a soft abrasive belt work area being unsupported; and an arcuate belt work area being supported by a wheel.

* * * * *